US011577523B2

(12) United States Patent
Yoneta

(10) Patent No.: US 11,577,523 B2
(45) Date of Patent: Feb. 14, 2023

(54) LIQUID DISCHARGE APPARATUS

(71) Applicant: Ricoh Company, Ltd., Tokyo (JP)

(72) Inventor: Ryohta Yoneta, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 65 days.

(21) Appl. No.: 17/136,207

(22) Filed: Dec. 29, 2020

(65) Prior Publication Data

US 2021/0229455 A1 Jul. 29, 2021

(30) Foreign Application Priority Data

Jan. 27, 2020 (JP) ..... JP2020-010621

(51) Int. Cl.
*B41J 2/175* (2006.01)

(52) U.S. Cl.
CPC ..... *B41J 2/17596* (2013.01)

(58) Field of Classification Search
CPC .... B41J 2/17563; B41J 2/17596; B41J 2/055; B41J 2/14274; B41J 2/16538; B41J 2/1652; B41J 2/16508
See application file for complete search history.

(56) References Cited

U.S. PATENT DOCUMENTS 10,981,382 B2 * 4/2021 Yoshida ..... B41J 2/18
2013/0233948 A1 9/2013 Yoneta
2014/0071215 A1 3/2014 Yoneta
2014/0218450 A1 8/2014 Yoneta
2014/0253648 A1 9/2014 Yoneta
2015/0015646 A1 1/2015 Yoneta
2015/0077471 A1 3/2015 Yoneta
2018/0072066 A1 3/2018 Yoneta
2020/0164644 A1 5/2020 Yoneta et al.

FOREIGN PATENT DOCUMENTS

JP 2014-233937 12/2014
JP 2018-154065 10/2018

* cited by examiner

*Primary Examiner* — An H Do
(74) *Attorney, Agent, or Firm* — Xsensus LLP

(57) ABSTRACT

A liquid discharge apparatus includes a plurality of heads configured to discharge a liquid, a supply channel connected to the plurality of heads, the supply channel configured to supply the liquid to the plurality of heads, a collection channel connected to the plurality of heads, the collection channel configured to collect the liquid from the plurality of heads, a supply damper configured to define a deformable wall of the supply channel, a collection damper configured to define a deformable wall of the collection channel, a supply damper chamber facing the supply damper, a collection damper chamber facing the collection damper, a pressure pump configured to apply a pressure to the supply damper chamber, and a depressurize pump configured to apply a negative pressure to the collection damper chamber.

7 Claims, 18 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-010621, filed on Jan. 27, 2020, in the Japan Patent Office, the entire disclosures of which is hereby incorporated by reference herein.

BACKGROUND

Technical Field

Aspect of this disclosure relates to a liquid discharge apparatus.

Related Art

A liquid discharge apparatus includes a plurality of circulation type heads in each of which a liquid is circulated through an inner channel. The liquid is circulated through two or more heads via a supply channel and a collection channel common to the tow or more heads.

The head includes a supply channel, a collection channel, a supply damper, and a collection damper. The supply channel includes a supply manifold connected to a plurality of head modules. The collection channel includes a collection manifold. The supply damper includes a liquid chamber and an air chamber partitioned by a flexible film in the supply channel. The collection damper also includes a liquid chamber and an air chamber partitioned by a flexible film in the collection channel.

SUMMARY

In an aspect of this disclosure, a liquid discharge apparatus includes a plurality of heads configured to discharge a liquid, a supply channel connected to the plurality of heads, the supply channel configured to supply the liquid to the plurality of heads, a collection channel connected to the plurality of heads, the collection channel configured to collect the liquid from the plurality of heads, a supply damper configured to define a deformable wall of the supply channel, a collection damper configured to define a deformable wall of the collection channel, a supply damper chamber facing the supply damper, a collection damper chamber facing the collection damper, a pressure pump configured to apply a pressure to the supply damper chamber, and a depressurize pump configured to apply a negative pressure to the collection damper chamber.

In another aspect of this disclosure, a liquid discharge apparatus includes a head configured to discharge a liquid, a pressure pump configured to apply a pressure to the head, and a depressurize pump configured to apply a negative pressure to the head. The head includes a plurality of nozzles from which a liquid is discharged, a plurality of pressure chambers respectively communicating with the plurality of nozzles, a common-supply channel connected to each of the plurality of pressure chambers, the common-supply channel configured to supply the liquid to each of the plurality of pressure chambers, a common-collection channel connected to each of the plurality of pressure chambers, the common-collection channel configured to collect the liquid from each of the plurality of pressure chambers, a supply damper configured to define a deformable wall of the common-supply channel, a collection damper configured to define a deformable wall of the common-collection channel, a supply damper chamber facing the supply damper, and a collection damper chamber facing the collection damper. The pressure pump is configured to apply the pressure to the supply damper chamber in the head, and the depressurize pump is configured to apply the negative pressure to the collection damper chamber in the head.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
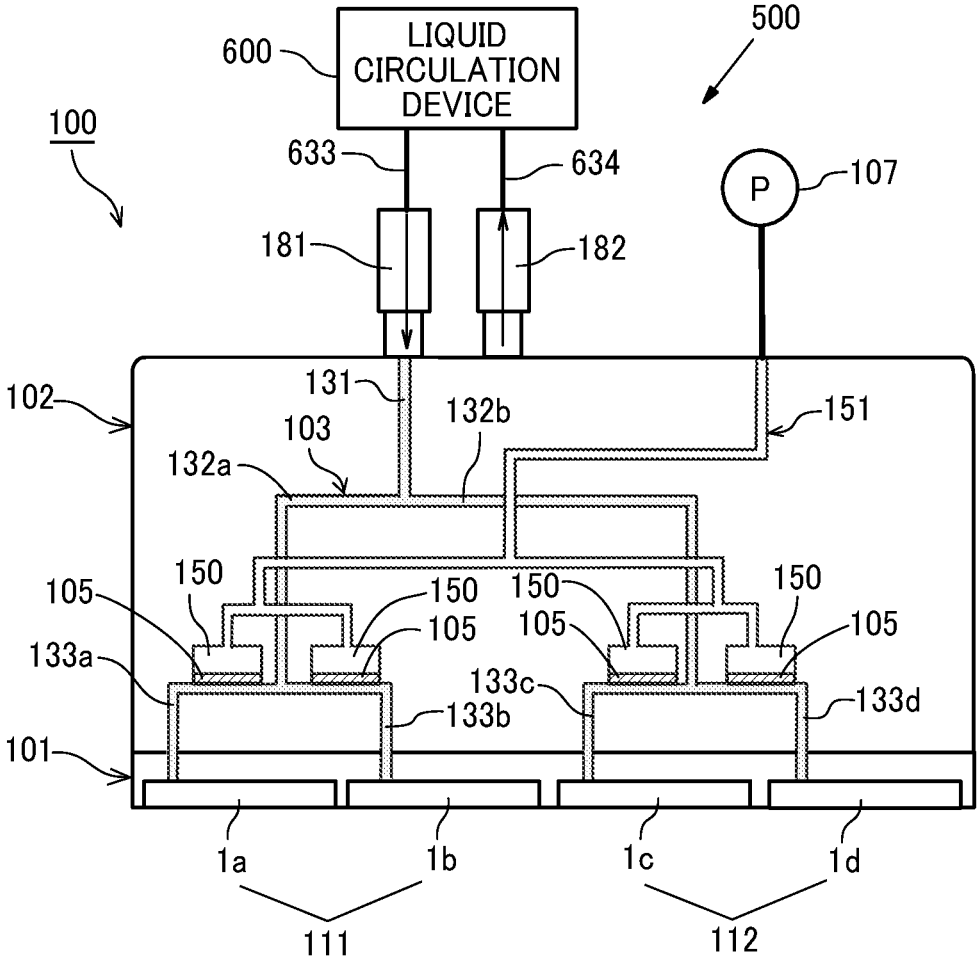
FIG. 1 is a schematic cross-sectional side view of a supply channel system according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. A liquid discharge apparatus according to a first embodiment of the present disclosure is described with reference to FIGS. 1 to 4.

FIG. 1 is a schematic cross-sectional side view of a supply channel system according to the first embodiment of the present disclosure.

Figure 2:
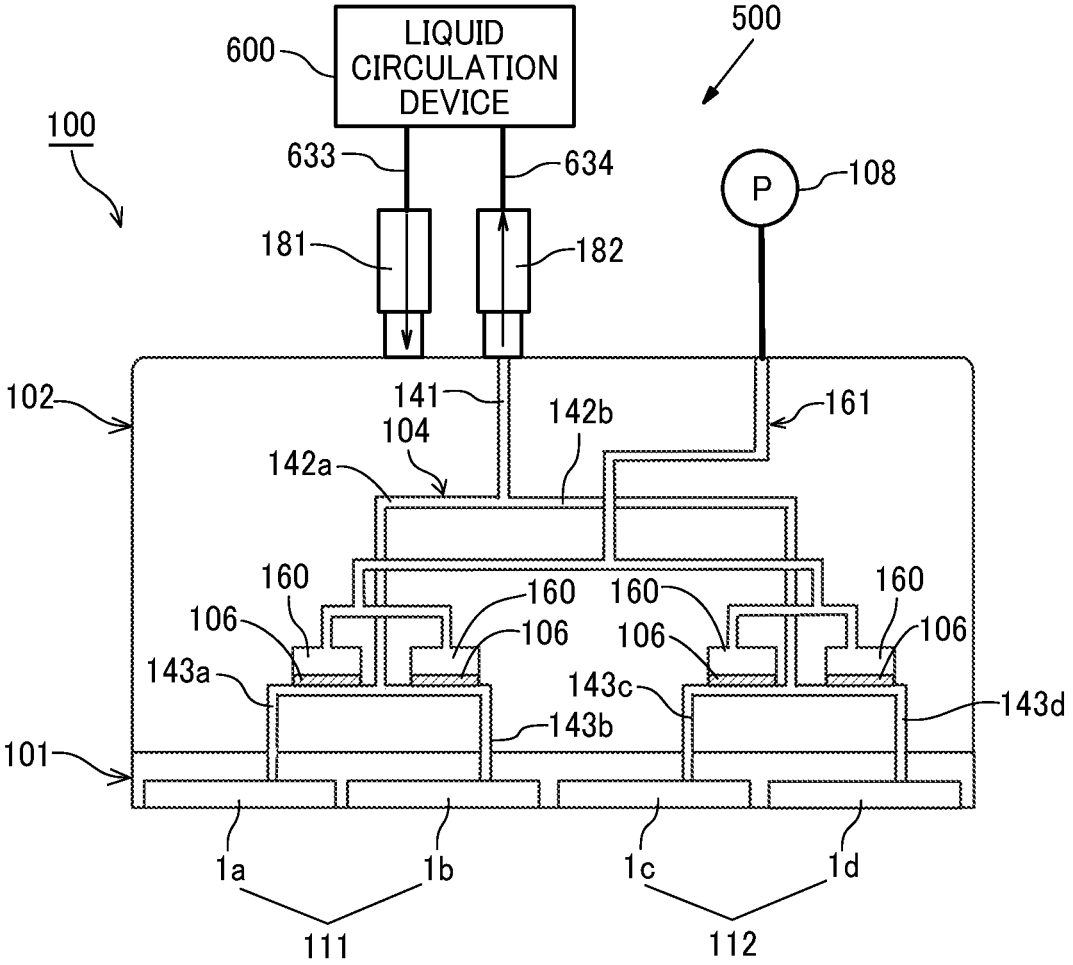
FIG. 2 is a schematic cross-sectional side view of a collection channel system according to the first embodiment of the present disclosure.

FIG. 2 is a schematic cross-sectional side view of a collection channel system according to the first embodiment of the present disclosure.

Figure 3:
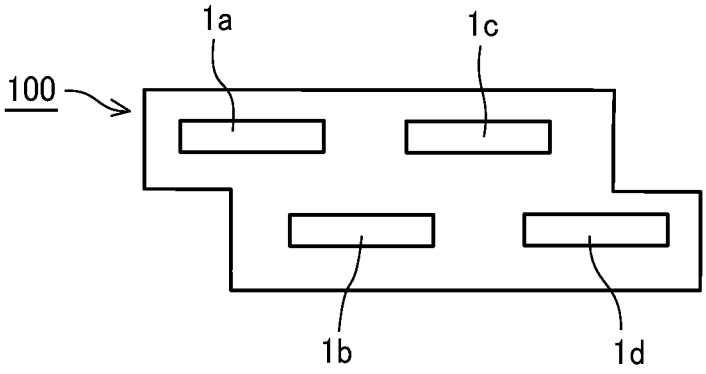
FIG. 3 is a schematic plan view of a head module 100 viewed from a nozzle surface of the head module.

FIG. 3 is a schematic plan view of a head module 100 viewed from a nozzle surface of the head module 100.

Figure 4A:
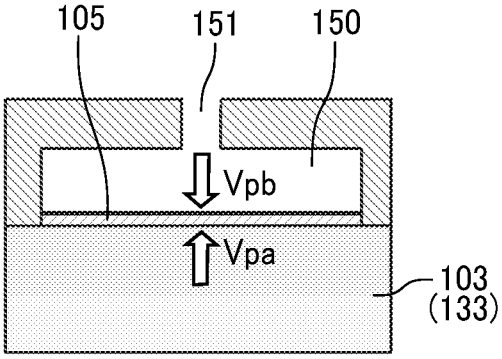
FIGS. 4A and 4B are cross-sectional side views of a supply damper in a supply channel and a collection damper in a collection channel according to the first embodiment of the present disclosure.
Figure 4B:
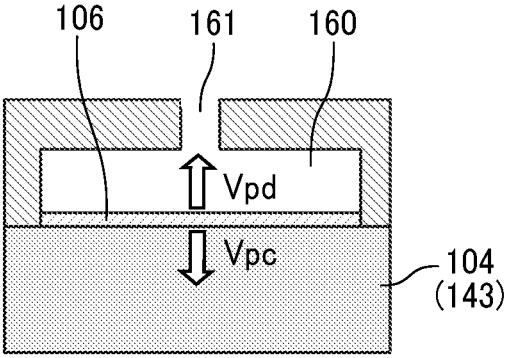

FIGS. 4A and 4B are cross-sectional side views of a supply damper 105 of a supply channel 103 and a collection damper 106 of a collection channel 104 according to the first embodiment of the present disclosure.

The liquid discharge apparatus 500 includes a head module 100, a liquid circulation device 600, a pressure pump 107, and a depressurize pump 108. The liquid circulation device 600 circulates a liquid through the head 1 of the head module 100.

The head module 100 includes a submodule 101 and a manifold 102. The submodule 101 includes four circulation-type heads 1 (1*a* to 1*d*) arranged in a staggered manner.

The manifold 102 includes a supply channel 103 and a collection channel 104. The supply channel supplies the liquid to each head 1 of the submodule 101. The collection channel 104 collects the liquid from each head 1. The manifold 102 includes a supply port 181 connected to the liquid circulation device 600 through the liquid supply channel 633. The manifold 102 includes a collection port 182 connected to the liquid circulation device 600 through a liquid collection channel 634.

The supply channel 103 of the manifold 102 includes a common-supply channel 131, two branch common-supply channels 132 (132*a* and 132*b*), and four individual-supply channels 133 (133*a* to 133*d*).

The common-supply channel 131 is a common-supply channel for the four heads 1*a* to 1*d*. The branch common-supply channel 132 is a supply channel branched into two from the common-supply channel 131. The branch common-supply channel 132*a* is a supply channel common to a head group 111 including the heads 1*a* and 1*b*. The branch common-supply channel 132*b* is a supply channel common to a head group 112 including the heads 1*c* and 1*d*.

The individual-supply channels 133 (133*a* to 133*d*) are supply channels further branched for each head 1 (1*a* to 1*d*) from the branch common-supply channels 132 (132*a* and 132*b*).

The collection channel 104 of the manifold 102 includes a common-collection channel 141, two branch common-collection channels 142 (142*a* and 142*b*), and four individual-collection channels 143 (143*a* to 143*d*).

The common-collection channel 141 is a common-collection channel for the four heads 1*a* to 1*d*. The branch common-collection channel 142 is a collection channel branched into two from the common-collection channel 141. The branch common-collection channel 142*a* is a collection channel common to a head group 111 including the heads 1*a* and 1*b*. The branch common-collection channel 142*b* is a collection channel common to a head group 112 including the heads 1*c* and 1*d*.

The individual-collection channels 143 (143*a* to 143*d*) are collection channels further branched for each head 1 (1*a* to 1*d*) from the branch common-collection channels 142 (142*a* and 142*b*).

Then, each of four individual-supply channel 133 (133*a* to 133*d*) includes a supply damper 105 that forms (defines) a deformable wall of the individual-supply channel 133.

The manifold 102 includes a supply damper chamber 150 and a channel 151. The supply damper chamber 150 is a supply air chamber in contact with the supply damper 105 of the individual-supply channel 133. Thus, the supply damper 105 also forms a part of a wall of the supply damper chamber 150. The channel 151 collectively connects the four supply damper chambers 150 to outside the manifold 102.

The channel 151 communicates with the four supply damper chambers 150. The channel 151 is connected to a pressure pump 107 serving as a pressure device to apply pressure to the supply damper chambers 150.

Further, each of the individual-collection channel 143 (143*a* to 143*d*) includes a collection damper 106 that forms (defines) a deformable wall of the individual-collection channel 143.

Thus, the supply damper 105 includes a plurality of supply dampers 105 respectively defines a plurality of deformable walls of the plurality of individual-supply channels 133, the collection damper 106 includes a plurality of collection dampers 106 respectively defines a plurality of deformable walls of the plurality of individual-collection channels 143, the supply damper chamber 150 includes a plurality of supply damper chambers 150 respectively facing the plurality of supply dampers 105, and the collection damper chamber 160 includes a plurality of collection damper chambers 160 respectively facing the plurality of collection dampers 106.

The manifold 102 includes a collection damper chamber 160 and a channel 161. The collection damper chamber 160 is a collection air chamber in contact with the collection damper 106 of the individual-collection channel 143. Thus, the collection damper 106 also forms a part of a wall of the collection damper chamber 160. The channel 161 collectively connects the four collection damper chambers 160 to outside the manifold 102.

The channel 161 communicates with the four collection damper chambers 160. The channel 161 is connected to a depressurize pump 108 serving as a depressurize device to reduce pressure inside the collection damper chambers 160.

Next, an effect of the supply damper 105 and the collection damper 106 of the manifold 102 according to the first embodiment of the present disclosure is described with reference to FIG. 5. FIGS. 5A and 5B are cross-sectional side views of the supply damper 105 and the collection damper 106 when a differential pressure is applied to the supply damper chamber 150 and the collection damper chamber 160 while the supply damper chamber 150 and the collection damper chamber 160 communicate with atmosphere according to the first embodiment.

To circulate the liquid through the head 1, the liquid circulation device 600 applies a pressure to the supply channel 103 and reduces pressure in the collection channel 104 to generate a differential pressure, for example. As a result, the liquid flows and circulates through the supply channel 103, the head 1, and the collection channel 104 of the head module 100.

Figure 5A:
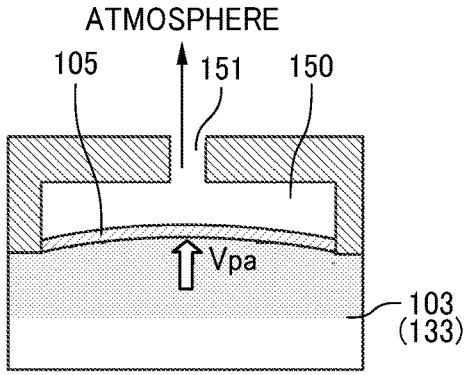
FIGS. 5A and 5B are cross-sectional side views of the supply damper and the collection damper when a differential pressure is applied to the supply damper chamber and the collection damper chamber while the supply damper chamber and the collection damper chamber communicate with atmosphere according to the first embodiment of the present disclosure.

Since the liquid circulation device 600 applies a circulation pressure Vpa to the supply channel 103, the supply damper 105 deforms upward in a convex-shape toward the supply damper chamber 150 by a circulation pressure Vpa when the supply damper chamber 150 and the supply damper 105 communicate with the atmosphere as illustrated in FIG. 5A.

Figure 5B:
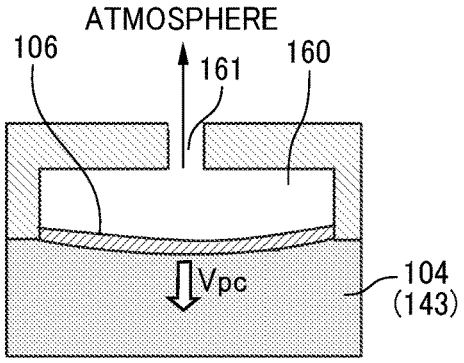

Since the liquid circulation device 600 applies negative pressure to (depressurize) the collection channel 104, the collection damper 106 deforms downward in a concave-shape opposite the collection damper chamber 160 (toward the collection channel 104) by a circulation pressure Vpc when the collection damper chamber 160 and the collection damper 106 communicate with the atmosphere as illustrated in FIG. 5B.

Thus, if the supply damper 105 deforms upward toward the supply damper chamber 150 in an initial state, the supply damper 105 cannot further deform upward toward the supply damper chamber 150 when the pressure in the supply channel 103 fluctuates. Thus, the supply damper 105 may not properly attenuate a pressure fluctuations in the supply channel 103 because an effect (function) of attenuating the pressure fluctuation of the supply damper 105 decreases.

Similarly, if the collection damper 106 deforms downward opposite the collection damper chamber 160 (toward the collection channel 104) in an initial state, the collection damper 106 cannot further deform downward opposite the collection damper chamber 160 (toward the collection channel 104) when the pressure in the collection channel 104 fluctuates. Thus, the collection damper 106 may not properly attenuate a pressure fluctuations in the collection channel 104 because an effect (function) of attenuating the pressure fluctuation of the collection damper 106 decreases.

Therefore, the liquid discharge apparatus 500 according to the first embodiment applies a back pressure Vpb to the supply damper 105 and the supply damper chamber 150 by the pressure pump 107 when the liquid is circulated through the head 1 by the differential pressure as illustrated in FIG. 4A. Thus, the liquid discharge apparatus 500 can reduce an initial deformation (displacement) of the supply damper 105.

That is, the liquid discharge apparatus 500 applies the back pressure Vpb to the supply damper chamber 150 by the pressure pump 107 so that the back pressure Vpb acts downward on the supply damper 105 against the circulation pressure Vpa acting upward on the supply damper 105 from the individual-supply channel 133 of the supply channel 103. Thus, as illustrated in FIG. 4A, the back pressure Vpb acting downward on the supply damper 105 and the circulation pressure Vpa acting upward on the supply damper 105 are balanced on the supply damper 105 so that the supply damper 105 is kept flat.

Similarly, the liquid discharge apparatus 500 according to the first embodiment applies a negative pressure Vpd to (depressurize) the collection damper 106 and the collection damper chamber 160 by the depressurize pump 108 when the liquid is circulated through the head 1 by the differential pressure as illustrated in FIG. 4B. Thus, the liquid discharge apparatus 500 can reduce an initial deformation (displacement) of the collection damper 106.

That is, the liquid discharge apparatus 500 applies the back pressure Vpd to the collection damper chamber 160 by the depressurize pump 108 so that the back pressure Vpd acts upward on the collection damper 106 against the circulation pressure Vpc acting downward on the collection damper 106 from the individual-collection channel 143 of the collection channel 104. Thus, as illustrated in FIG. 4B, the back pressure Vpd acting upward on the collection damper 106 and the circulation pressure Vpc acting downward on the collection damper 106 are balanced on the collection damper 106 so that the collection damper 106 is kept flat.

As described above, the liquid discharge apparatus 500 in the first embodiment reduces the initial deformation of the supply damper 105 and the collection damper 106 due to the circulation pressure Vpa and Vpc for liquid circulation.

Thus, the supply damper 105 and the collection damper 106 of the liquid discharge apparatus 500 according to the first embodiment can deform and attenuate the pressure fluctuation in the supply channel 103 and in the collection channel 104 when the pressure fluctuation occurs in the supply channel 103 and in the collection channel 104, respectively. Thus, the liquid discharge apparatus 500 can effectively attenuate the pressure fluctuation in the supply channel 103 and the collection channel 104.

Figure 6A:
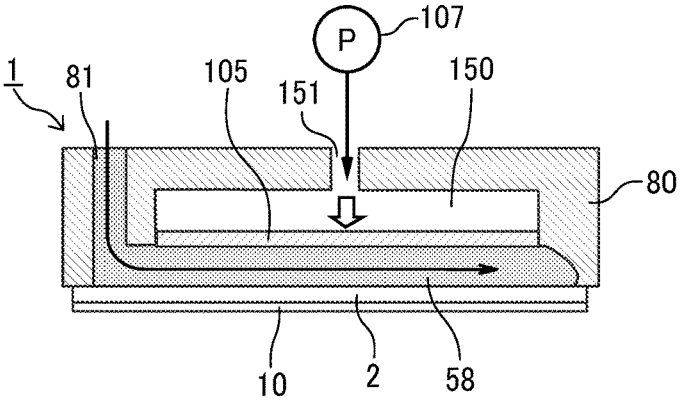
FIGS. 6A and 6B are schematic cross-sectional side views of the liquid discharge apparatus according to a second embodiment of the present disclosure.
Figure 6B:
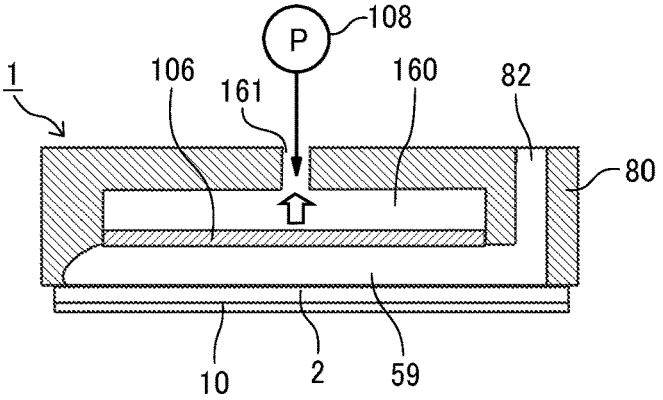

A liquid discharge apparatus 500 according to a second embodiment of the present disclosure is described with reference to FIGS. 6A and 6B. FIGS. 6A and 6B are schematic cross-sectional side views of the liquid discharge apparatus 500 according to the second embodiment of the present disclosure.

A liquid from the liquid circulation device 600 is supplied to the common-supply channel 58 of the head 1 via the supply port 81 in a frame 80. The liquid supplied from the common-supply channel 58 and not discharged from a nozzle in a nozzle plate 10 passes through inner individual-collection channels 143 such as pressure chambers 21 (see FIG. 19) in the actuator substrate 2 and flows to the common-collection channel 59. The liquid flown to the common-collection channel 59 is collected to the liquid circulation device 600 through the collection port 82.

The manifold 102 includes the supply damper 105 that forms a deformable wall of the common-supply channel 58 and the supply damper chamber 150 facing (contacting) the supply damper 105. The supply damper 105 also forms a deformable wall of the supply damper chamber 150 as illustrated in FIG. 6A. The supply damper chamber 150 is connected to the pressure pump 107 via the channel 151.

Further, the manifold 102 includes the collection damper 106 and the collection damper chamber 160. The collection damper forms a deformable wall of the common-collection channel 59. The collection damper chamber 160 is in contact with the collection damper 106. In other words, the collection damper 106 forms a part of wall of the collection damper chamber 160. The collection damper chamber 160 is connected to the depressurize pump 108 via the channel 161.

Figure 7A:
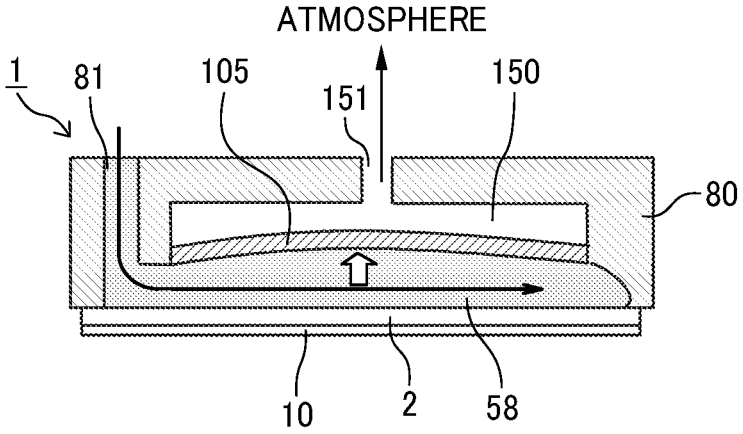
FIGS. 7A and 7B are cross-sectional side views of the supply damper and the collection damper when a differential pressure is applied to the supply damper chamber and the collection damper chamber while the supply damper chamber and the collection damper chamber communicate with atmosphere according to the second embodiment.
Figure 7B:
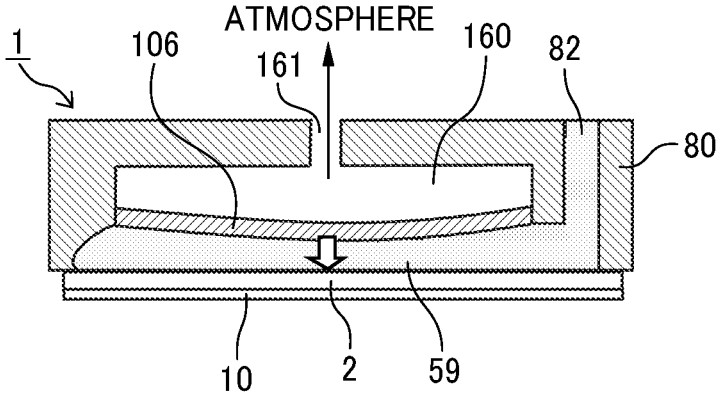

An operation of the liquid discharge apparatus 200 according to the second embodiment of the present disclosure is described with reference to FIGS. 7A and 7B. FIGS. 7A and 7B are cross-sectional side views of the supply damper 105 and the collection damper 106 when a differential pressure is applied to the supply damper chamber 150 and the collection damper chamber 160 while the supply damper chamber 150 and the collection damper chamber 160 communicate with atmosphere according to the second embodiment.

To circulate the liquid through the head 1, the liquid circulation device 600 applies a pressure to the common-supply channel 58 and applies negative pressure to (depressurize) the common-collection channel 59 to generate a differential pressure, for example, as similar to the liquid discharge apparatus 500 according to the first embodiment. As a result, the liquid flows and circulates in the order of the common-supply channel 58 (see FIG. 7A), the pressure chamber 21 (see FIG. 19), and the common-collection channel 59 (see FIG. 7B).

Since the liquid circulation device 600 applies the pressure to the common-supply channel 58, the supply damper 105 deforms upward in a convex-shape toward the supply damper chamber 150 by the circulation pressure Vpa when the supply damper chamber 150 and the supply damper 105 communicate with the atmosphere as illustrated in FIG. 7A.

Since the liquid circulation device 600 applies negative pressure to (depressurize) the common-collection channel 59, the collection damper 106 deforms downward in a concave-shape opposite the collection damper chamber 160 (toward the common-collection channel 59) by the circulation pressure Vpc when the collection damper chamber 160 and the collection damper 106 communicate with the atmosphere as illustrated in FIG. 7B.

Thus, if the supply damper 105 deforms upward toward the supply damper chamber 150 in a convex-shape in an initial state, the supply damper 105 cannot further deform upward toward the supply damper chamber 150 in the convex-shape when the pressure in the common-supply channel 58 fluctuates. Thus, the supply damper 105 may not properly attenuate a pressure fluctuations in the common-supply channel 58 because an effect (function) of attenuating the pressure fluctuation of the supply damper 105 decreases.

Similarly, if the collection damper 106 deforms downward opposite the collection damper chamber 160 (toward the common-collection channel 59) in an initial state, the collection damper 106 cannot further deform downward opposite the collection damper chamber 160 (toward the common-collection channel 59) when the pressure in the common-collection channel 59 fluctuates. Thus, the supply damper 105 may not properly attenuate a pressure fluctuations in the common-supply channel 58 because an effect (function) of attenuating the pressure fluctuation of the supply damper 105 decreases.

Therefore, the liquid discharge apparatus 500 according to the second embodiment applies a pressure to the supply damper 105 and the supply damper chamber 150 by the pressure pump 107 when the liquid is circulated through the head 1 by the differential pressure as illustrated in FIG. 6A. Thus, the liquid discharge apparatus 500 can reduce an initial deformation (displacement) of the supply damper 105.

Similarly, the liquid discharge apparatus 500 according to the second embodiment applies a negative pressure to (depressurize) the collection damper 106 and the collection damper chamber 160 by the depressurize pump 108 when the liquid is circulated through the head 1 by the differential pressure as illustrated in FIG. 6B. Thus, the liquid discharge apparatus 500 can reduce an initial deformation (displacement) of the collection damper 106.

Thus, the liquid discharge apparatus 500 in the second embodiment reduces the initial deformation of the supply damper 105 and the collection damper 106 by the differential pressure.

Thus, the supply damper 105 and the collection damper 106 of the liquid discharge apparatus 500 according to the second embodiment can deform and attenuate the pressure fluctuation in the common-supply channel 58 and in the common-collection channel 59 when the pressure fluctuation occurs in the common-supply channel 58 and in the common-collection channel 59, respectively. Thus, the liquid discharge apparatus 500 according to the second embodiment can effectively attenuate the pressure fluctuation in the common-supply channel 58 and the common-collection channel 59.

Figure 8:
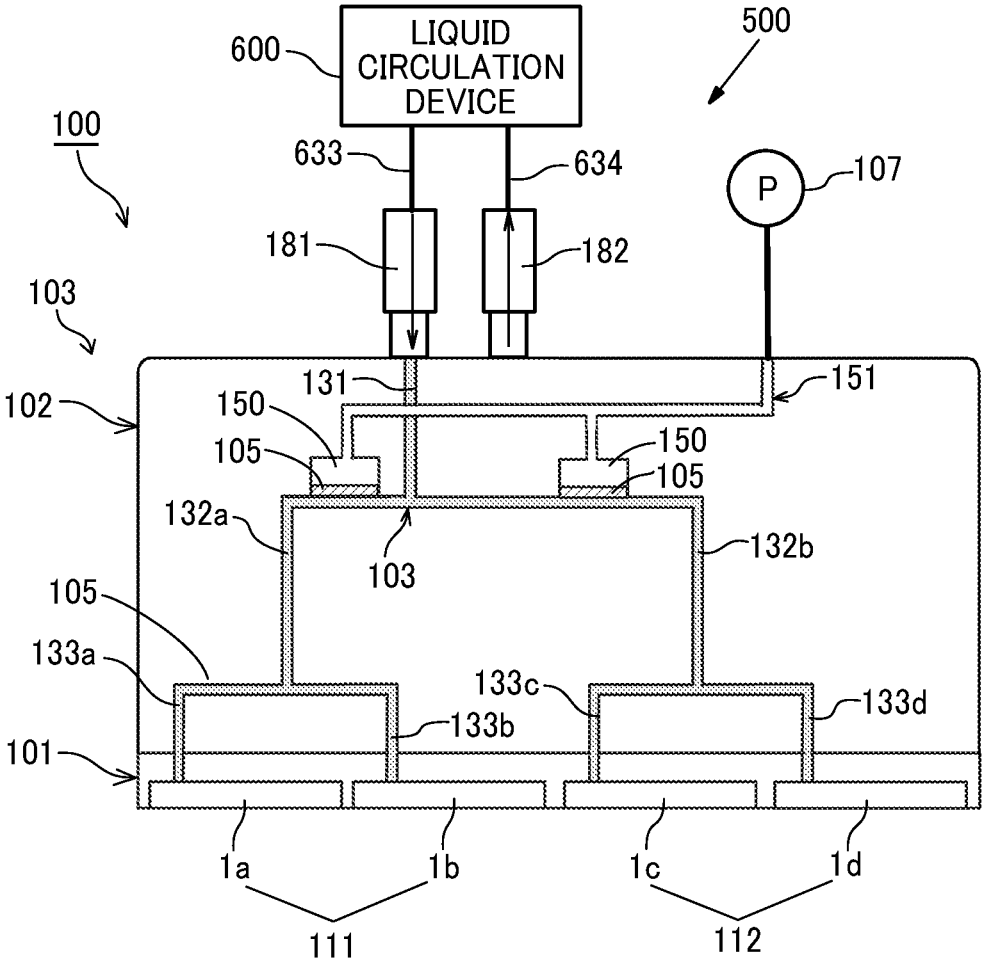
FIG. 8 is a schematic cross-sectional side view of a supply channel system according to a third embodiment of the present disclosure.
Figure 9:
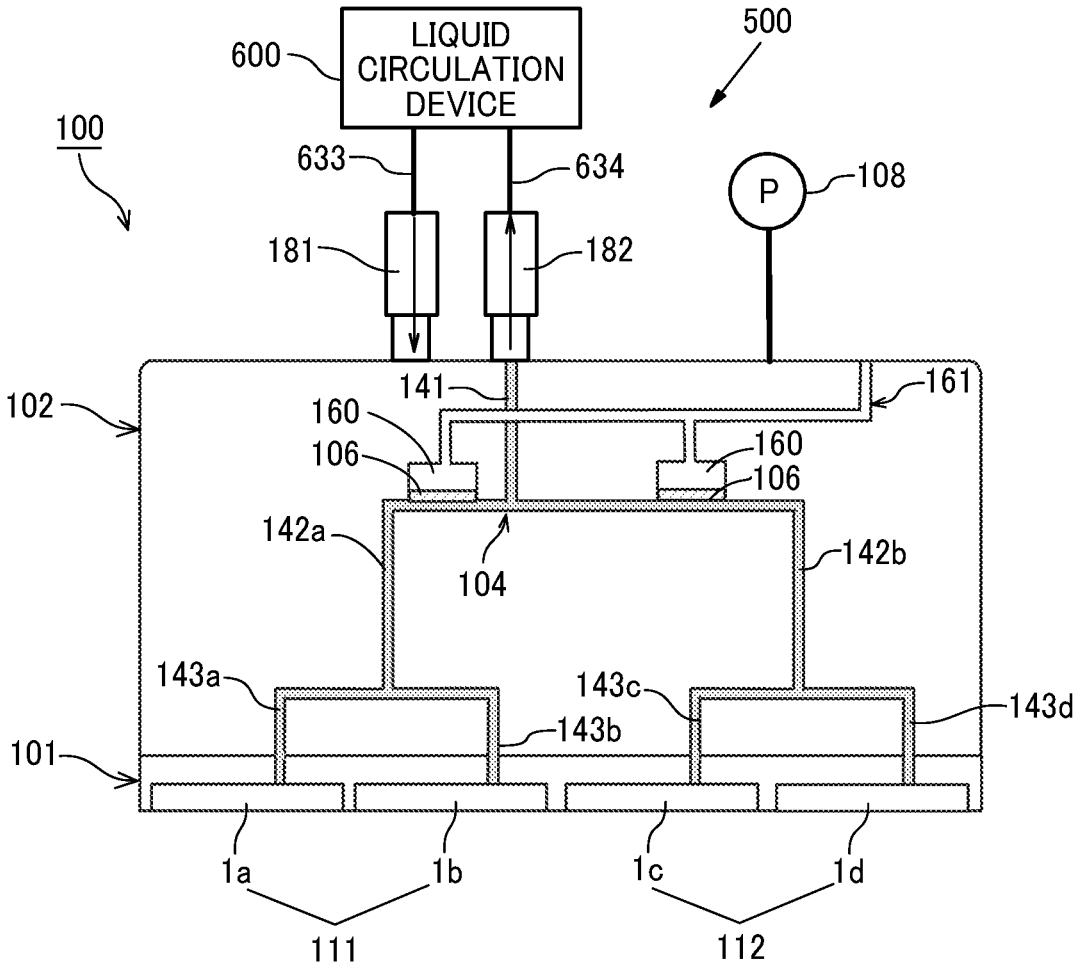
FIG. 9 is a schematic cross-sectional side view of a collection channel system according to the third embodiment of the present disclosure.

A liquid discharge apparatus 500 according to a third embodiment of the present disclosure is described with reference to FIGS. 8 and 9. FIG. 8 is a schematic cross-sectional side view of a supply channel system according to the third embodiment of the present disclosure. FIG. 9 is a schematic cross-sectional side view of a collection channel system according to the third embodiment of the present disclosure.

The liquid discharge apparatus 500 according to the third embodiment includes the supply damper 105 in the branch common-supply channel 132 (132*a* and 132*b*) for the head groups 111 and 112. Further, the liquid discharge apparatus 500 according to the third embodiment includes the collection damper 106 in the branch common-collection channel 142 (142*a* and 142*b*) for the head groups 111 and 112.

Further, the liquid discharge apparatus 500 in the third embodiment includes the pressure pump 107 and the depressurize pump 108 as in the liquid discharge apparatus 500 in the first embodiment. The pressure pump 107 applies pressure to the supply damper chamber 150 and the supply damper 105. The depressurize pump 108 applies a negative pressure to (depressurize) the collection damper chamber 160 and the collection damper 106.

Thus, the liquid discharge apparatus 500 respectively includes the supply damper 105 and the collection damper 106 in the branch common-supply channel 132 and the branch common-collection channel 142 common to the plurality of head groups 111 and 112. The liquid discharge apparatus 500 can also obtain the effect as described in the liquid discharge apparatus 500 according to the first embodiment.

Figure 10:
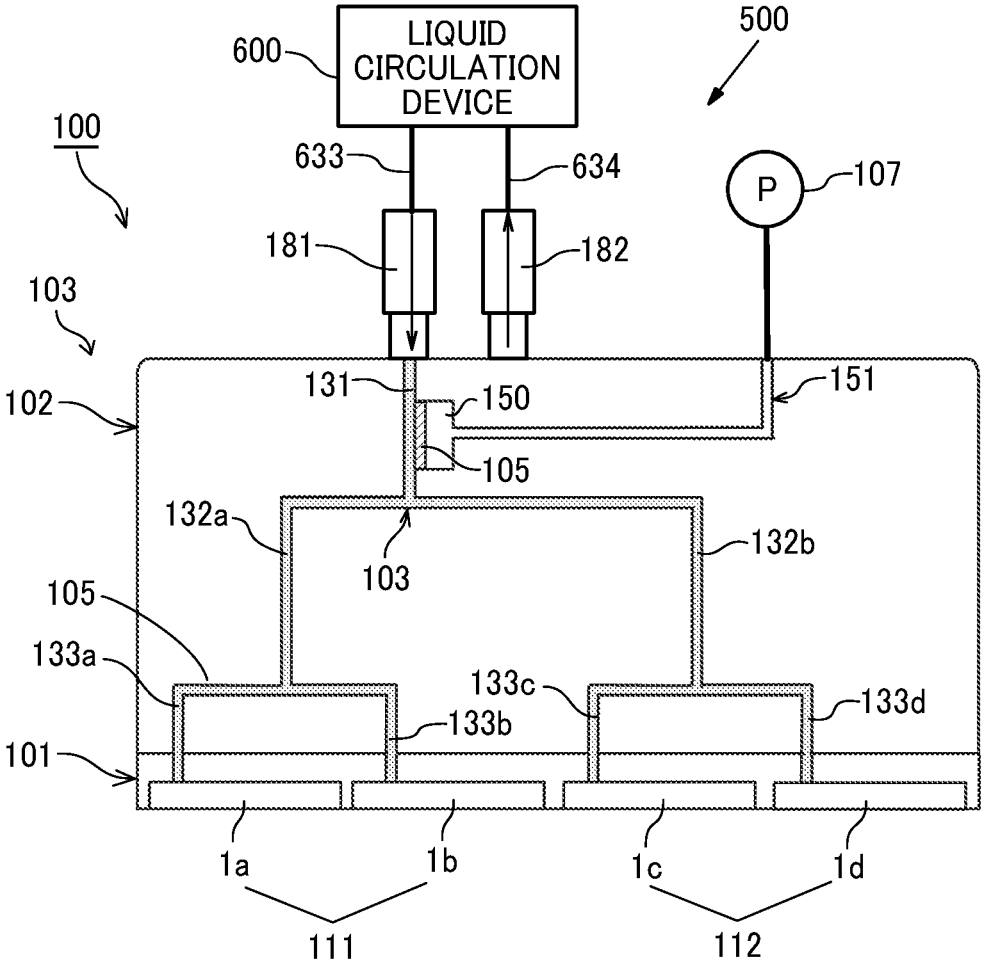
FIG. 10 is a schematic cross-sectional side view of a supply channel system according to a fourth embodiment of the present disclosure.
Figure 11:
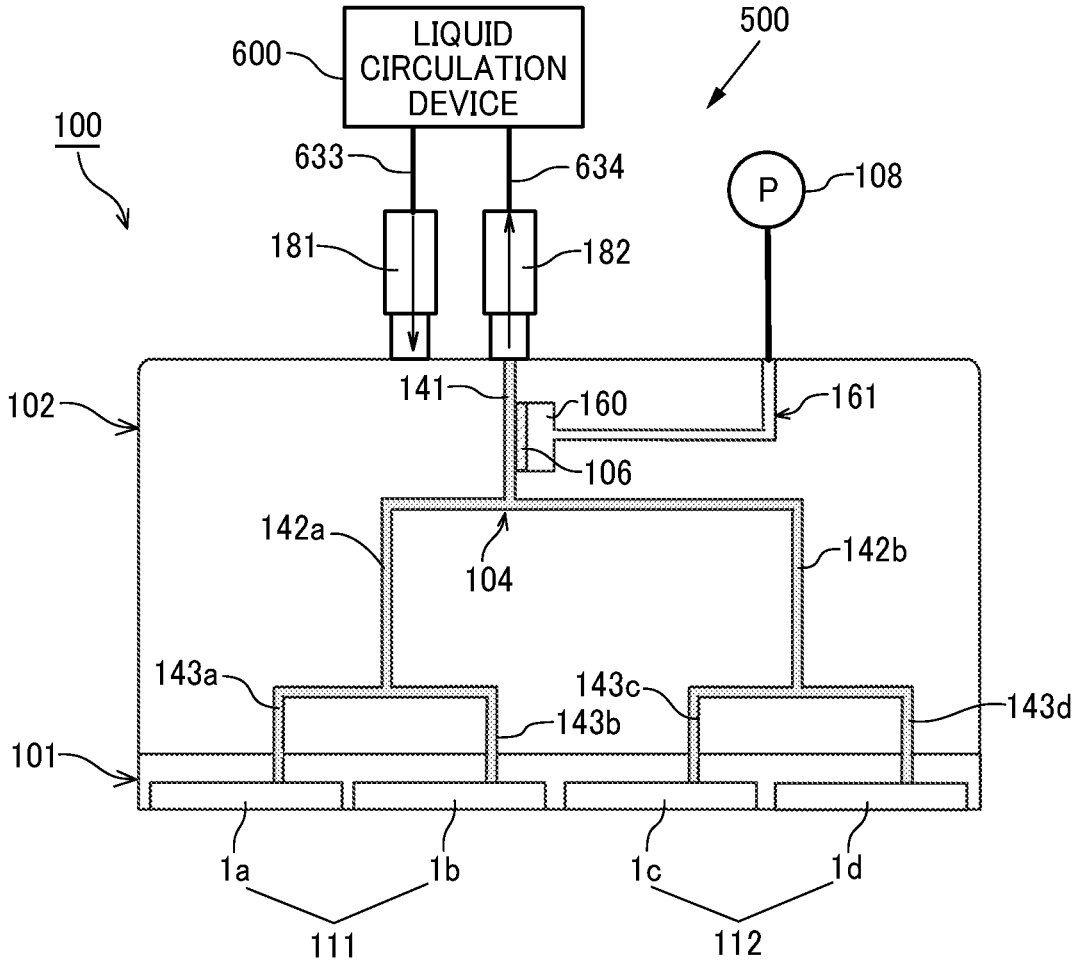
FIG. 11 is a schematic cross-sectional side view of a collection channel system according to the fourth embodiment of the present disclosure.

A liquid discharge apparatus 500 according to a fourth embodiment of the present disclosure is described with reference to FIGS. 10 and 11. FIG. 10 is a schematic cross-sectional side view of a supply channel system of the liquid discharge apparatus 500 according to the fourth embodiment of the present disclosure. FIG. 11 is a schematic cross-sectional side view of a collection channel system according to the fourth embodiment of the present disclosure.

The liquid discharge apparatus 500 according to the fourth embodiment includes the supply damper 105 in the common-supply channel 131. Further, the liquid discharge apparatus 500 according to the fourth embodiment includes the collection damper 106 in the common-collection channel 141.

Further, the liquid discharge apparatus 500 in the third embodiment includes the pressure pump 107 and the depressurize pump 108 as in the liquid discharge apparatus 500 in the first embodiment. The pressure pump 107 applies pressure to the supply damper chamber 150 and the supply damper 105. The depressurize pump 108 applies a negative pressure to (depressurize) the collection damper chamber 160 and the collection damper 106.

Thus, the liquid discharge apparatus 500 respectively includes the supply damper 105 and the collection damper 106 in the common-supply channel 131 and the common-collection channel 141 common to all the heads 1 of the head groups 111 and 112. The liquid discharge apparatus 500 in the fourth embodiment can also obtain the effect as described in the liquid discharge apparatus 500 according to the first embodiment.

A liquid discharge apparatus 500 according to a fifth embodiment of the present disclosure is described with reference to FIG. 12.

Figure 12:
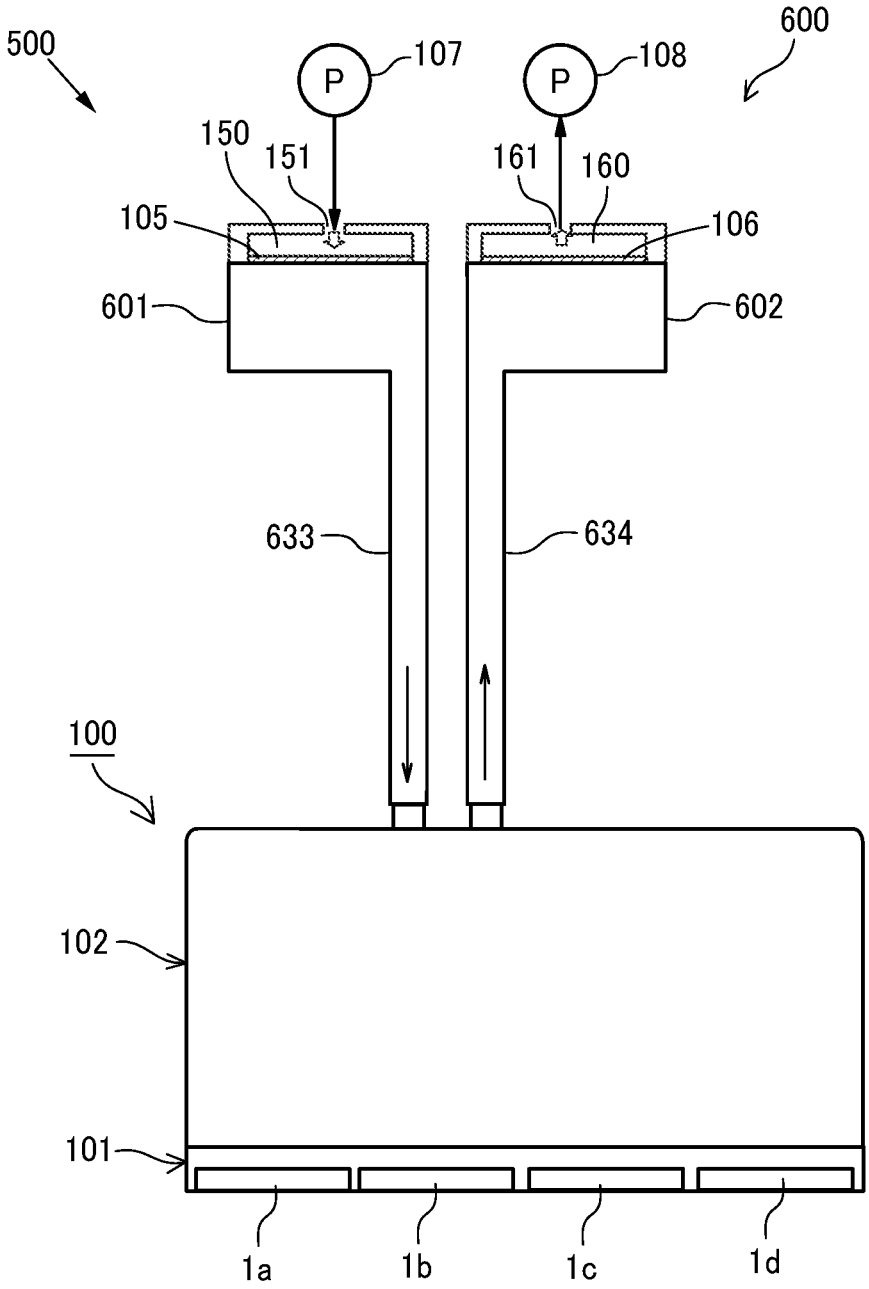
FIG. 12 is a schematic cross-sectional side view of a liquid discharge apparatus according to a fifth embodiment of the present disclosure.

FIG. 12 is a schematic cross-sectional side view of the liquid discharge apparatus 500 according to the fourth embodiment of the present disclosure.

The liquid circulation device 600 includes a supply tank 601 and a collection tank 602. The supply tank 601 is a supply reservoir to store a liquid to be supplied to the head module 100. The collection tank 602 is a collection reservoir to store a liquid collected from the head module 100.

The liquid discharge apparatus 500 includes a liquid supply channel 633 that connects the supply tank 601 and the head module 100 so that the liquid flows from the supply tank 601 to the head module 100 through the liquid supply channel 633.

The liquid discharge apparatus 500 includes a liquid collection channel 634 that connects the collection tank 602 and the head module 100 so that the liquid flows from head module 100 to the collection tank 602 through the liquid collection channel 634.

The supply tank 601 and the liquid supply channel 633 forms a part of the supply channel 103. The collection tank 602 and the liquid collection channel 634 forms a part of the collection channel 104.

Thus, the supply channel includes the supply tank 601 and the liquid supply channel 633, and the collection channel includes the collection tank 602 and the liquid collection channel 634.

The supply tank 601 includes a supply damper 105 that forms a deformable wall of the supply tank 601. The collection tank 602 includes a collection damper 106 that forms a deformable wall of the collection tank 602.

Further, the liquid discharge apparatus 500 in the fifth embodiment includes the pressure pump 107 and the depressurize pump 108 as in the liquid discharge apparatus 500 in the first embodiment. The pressure pump 107 applies pressure to the supply damper chamber 150 and the supply damper 105. The depressurize pump 108 applies a negative pressure to (depressurize) the collection damper chamber 160 and the collection damper 106.

Thus, the liquid discharge apparatus 500 in the fifth embodiment respectively includes the supply damper 105 and the collection damper 106 in the supply tank 601 and the collection tank 602 of the liquid circulation device 600. The liquid discharge apparatus 500 in the fifth embodiment can also obtain the effect as described in the liquid discharge apparatus 500 according to the first embodiment.

A liquid discharge apparatus 500 according to a sixth embodiment of the present disclosure is described with reference to FIG. 13.

Figure 13:
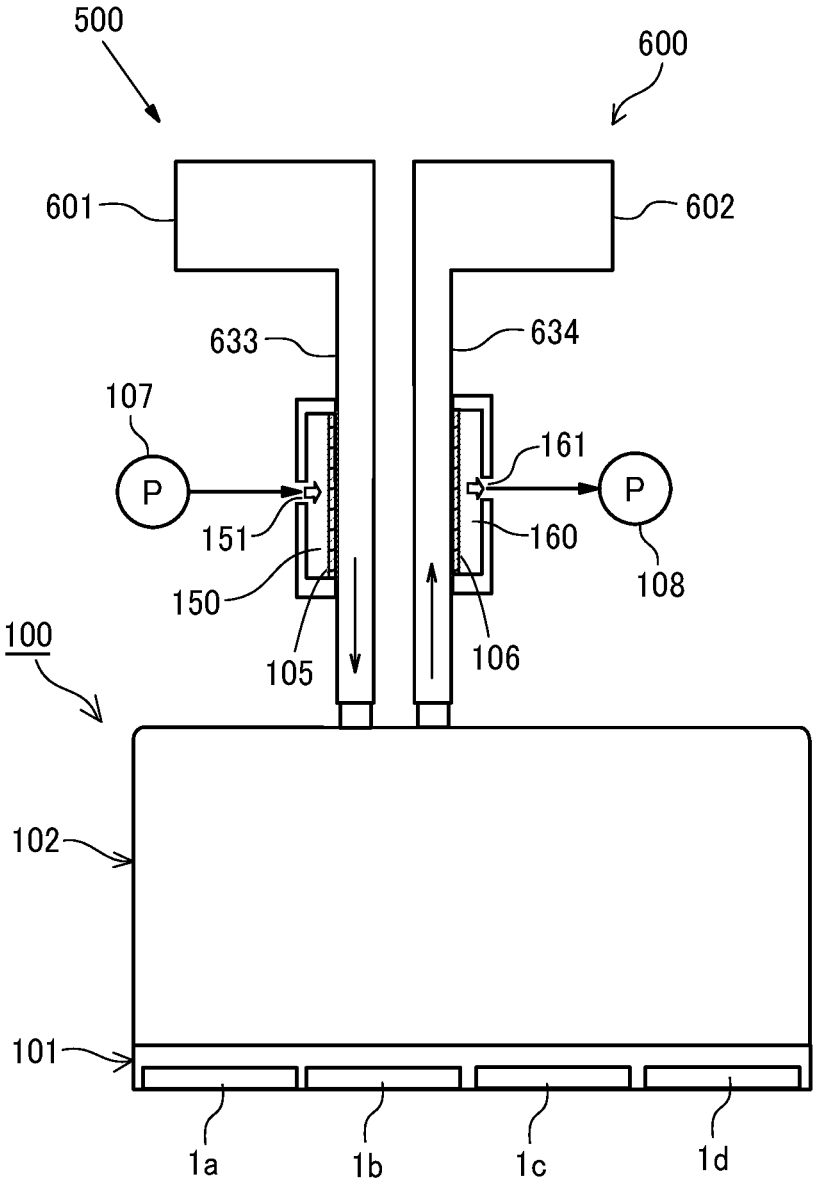
FIG. 13 is a schematic cross-sectional side view of a liquid discharge apparatus according to a sixth embodiment of the present disclosure.

FIG. 13 is a schematic cross-sectional side view of the liquid discharge apparatus 500 according to the sixth embodiment of the present disclosure.

The liquid circulation device 600 includes a supply tank 601 and a collection tank 602. The supply tank 601 is a supply reservoir to store a liquid to be supplied to the head module 100. The collection tank 602 is a collection reservoir to store a liquid collected from the head module 100.

The liquid discharge apparatus 500 includes a liquid supply channel 633 that connects the supply tank 601 and the head module 100 so that the liquid flows from the supply tank 601 to the head module 100 through the liquid supply channel 633. The liquid discharge apparatus 500 includes the supply damper 105 on the liquid supply channel 633 such that the supply damper 105 forms a deformable wall of the liquid supply channel 633. The liquid discharge apparatus 500 includes a liquid collection channel 634 that connects the collection tank 602 and the head module 100 so that the liquid flows from head module 100 to the collection tank 602 through the liquid collection channel 634. The liquid discharge apparatus 500 includes the collection damper 106 on the liquid collection channel 634 such that the collection damper 106 forms a deformable wall of the liquid collection channel 634.

Further, the liquid discharge apparatus 500 in the sixth embodiment includes the pressure pump 107 and the depressurize pump 108 as in the liquid discharge apparatus 500 in the first embodiment. The pressure pump 107 applies pressure to the supply damper chamber 150 and the supply damper 105. The depressurize pump 108 applies a negative pressure to (depressurize) the collection damper chamber 160 and the collection damper 106.

Thus, the liquid discharge apparatus 500 in the sixth embodiment respectively includes the supply damper 105 and the collection damper 106 on the liquid supply channel 633 connecting the supply tank 601 and the head module 100 and the liquid collection channel 634 connecting the collection tank 602 and the head module 100 of the liquid circulation device 600. The liquid discharge apparatus 500 in the sixth embodiment can also obtain the effect as described in the liquid discharge apparatus 500 according to the first embodiment.

In each of the above embodiments, the liquid circulation device 600 applies a pressure to a supply side and applies a negative pressure to (depressurize) a collection side to apply a differential pressure to the head 1. The "supply side" (supply channel 103) includes the individual-supply channel 133, the supply damper chamber 150, the supply damper 105, the common-supply channel 58, the branch common-supply channel 132, the supply tank 601, and the liquid supply channel 633, for example. The "collection side" (collection channel 104) includes the individual-collection channel 143, the collection damper chamber 160, the collection damper 106, the common-collection channel 59, the branch common-collection channel 142, the collection tank 602, and the liquid collection channel 634. A configuration to apply the differential pressure is not limited to the configuration as described above, and other configurations may be used to apply differential pressure to the supply side and the collection side of the head 1.

For example, the liquid discharge apparatus 500 may apply a pressure on both of the supply side and the collection side and control the pressure on the supply side to be larger (higher) than the pressure on the collection side to apply a differential pressure to the head 1. The above-described liquid discharge apparatus 500 including a pressure pump that applies a pressure to the supply damper chamber 150 and a pressure pump that applies a pressure to the collection damper chamber 160 can obtain the same effects as the effects of each of the above-described embodiments.

Further, the liquid discharge apparatus 500 may apply a negative pressure on both of the supply side and the collection side and control the pressure on the supply side to be larger (higher) than the pressure on the collection side to apply a differential pressure to the head 1. The above-described liquid discharge apparatus 500 including a depressurize pump that applies a negative pressure to the supply damper chamber 150 and a depressurize pump that applies a negative pressure to the collection damper chamber 160 can obtain the same effects as the effects of each of the above-described embodiments.

An example of the head 1 of a circulation-type is described with reference to FIGS. 14 to 19.

Figure 14:
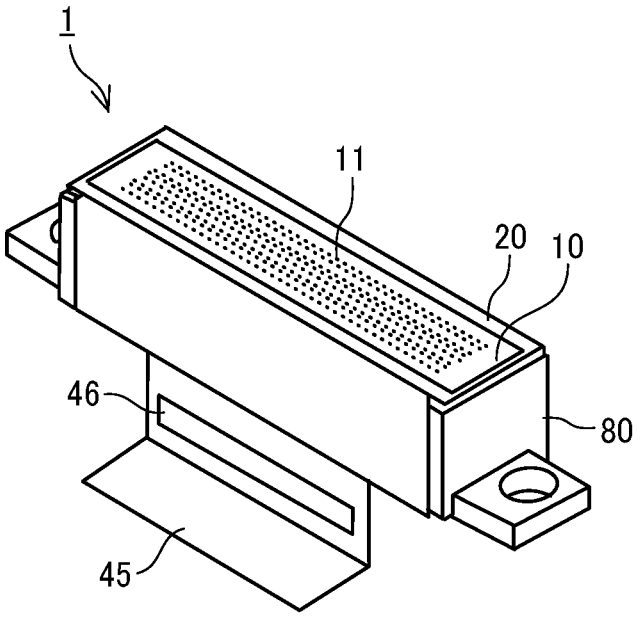
FIG. 14 is a schematic external perspective view of an example of a head of a circulation type as viewed from a nozzle surface side.

FIG. 14 is an external perspective view of the head 1 viewed from a nozzle surface of the head 1.

Figure 15:
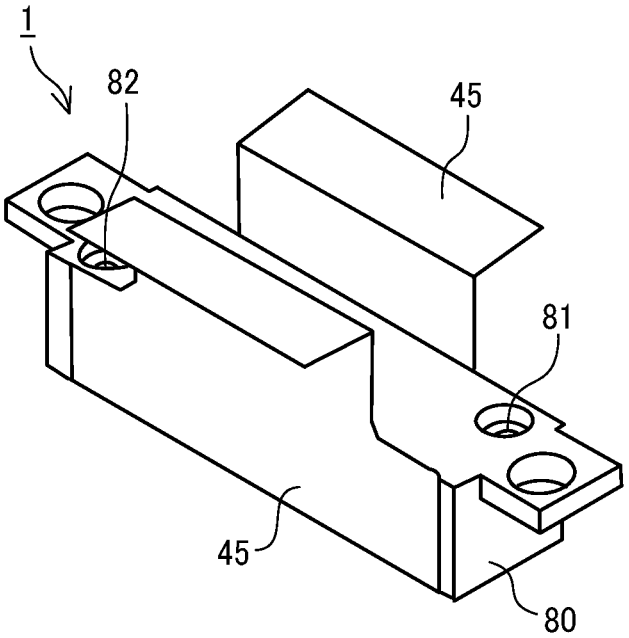
FIG. 15 is a schematic external perspective view of the head as viewed from an opposite side of the nozzle surface side.

FIG. 15 is an external perspective view of the head 1 viewed from a side opposite to the nozzle surface of the head 1.

Figure 16:
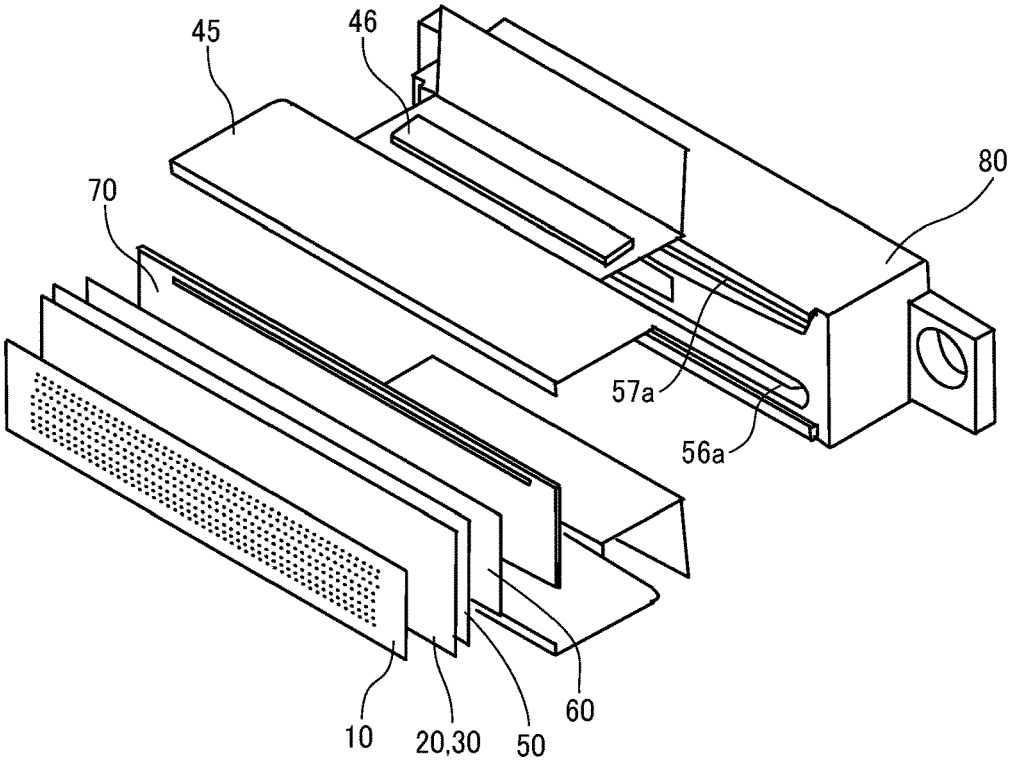
FIG. 16 is a schematic exploded perspective view of the head.

FIG. 16 is an exploded perspective view of the head 1.

Figure 17:
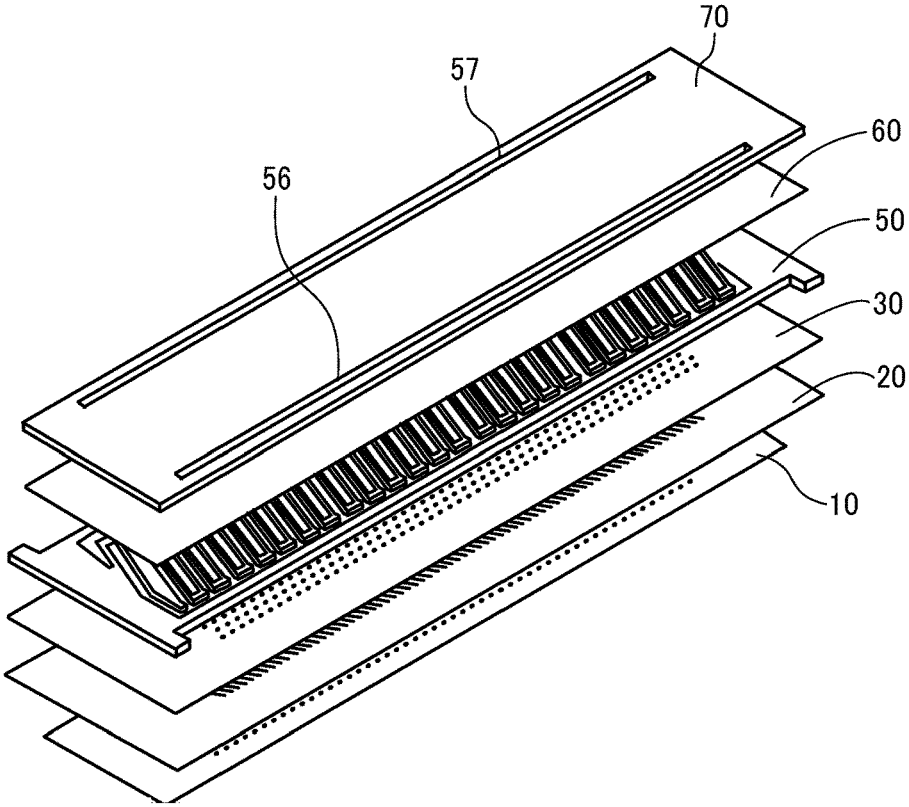
FIG. 17 is a schematic exploded perspective view of a channel forming member of the head.

FIG. 17 is an exploded perspective view of a channel forming member of the head 1.

Figure 18:
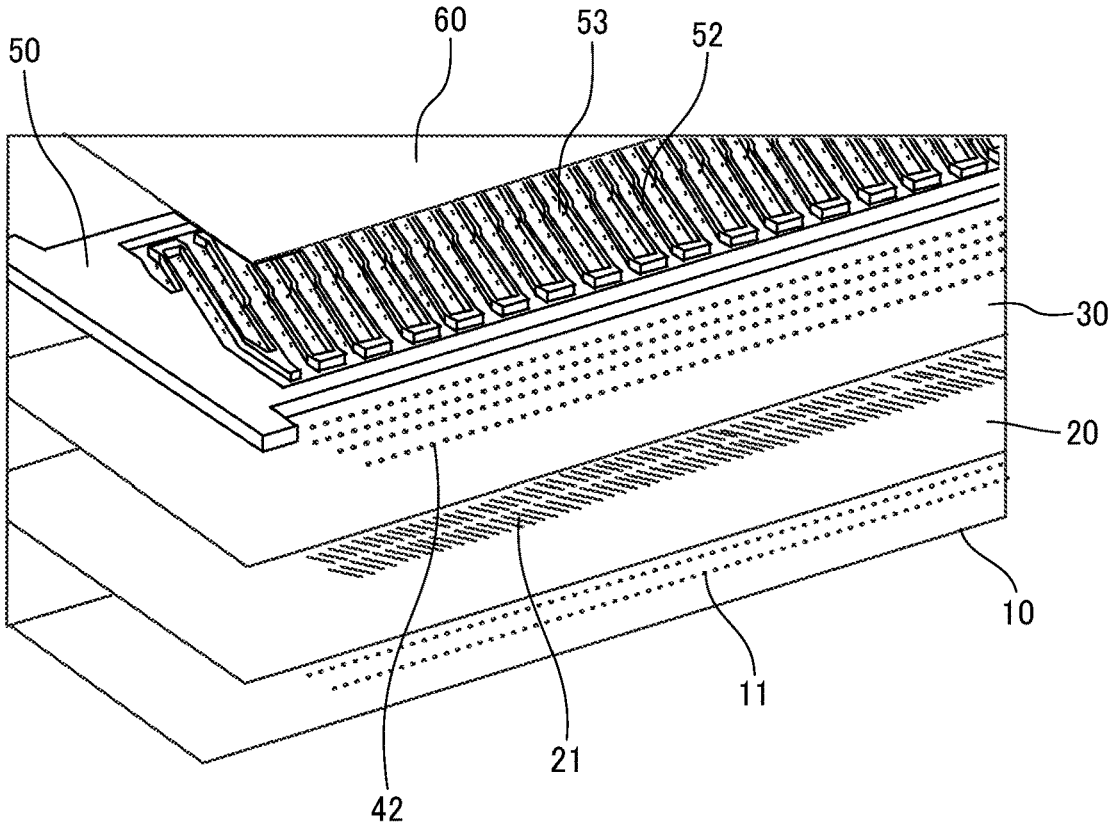
FIG. 18 is a schematic exploded perspective view of a portion of the channel forming member of FIG. 17.

FIG. 18 is an enlarged perspective view of a portion of the channel forming member of FIG. 17.

Figure 19:
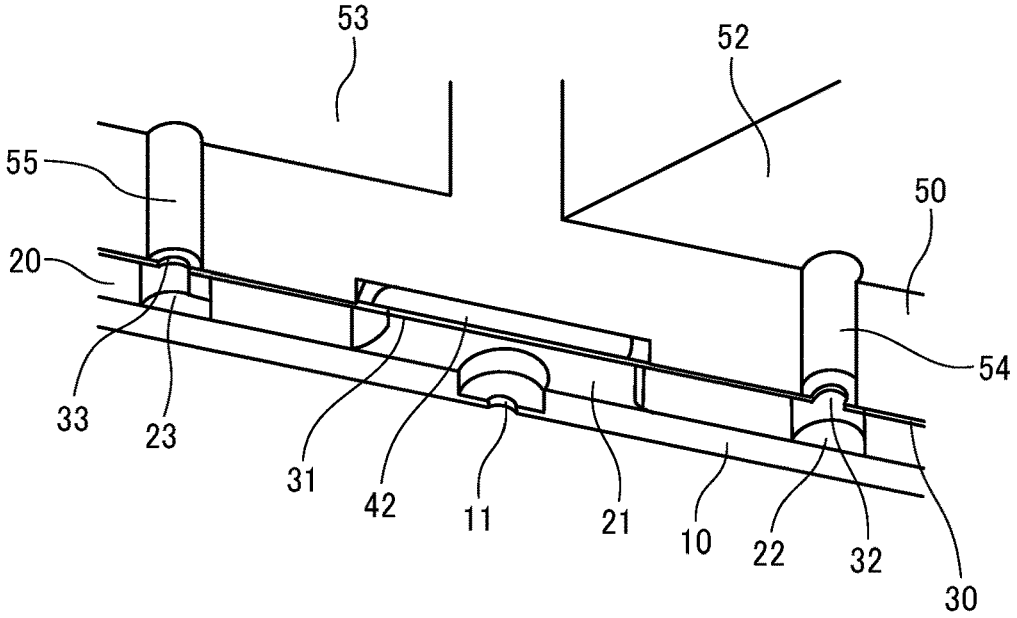
FIG. 19 is a schematic exploded cross-sectional perspective view of channels in the head.

FIG. 19 is a cross-sectional perspective view of channels of the head 1.

The head 1 includes a nozzle plate 10, an individual-channel member 20 (channel plate), a diaphragm member 30, a common channel member 50, a damper 60, a common channel member 70, a frame 80, and a flexible wiring board 45 (wiring). A head driver 46 (driver IC) is mounted on the flexible wiring board 45.

The nozzle plate 10 includes a plurality of nozzles 11 to discharge a liquid. The plurality of nozzles 11 are arrayed in a two-dimensional matrix.

The individual-channel member 20 (channel plate) includes a plurality of pressure chambers 21 (individual chambers) respectively communicating with the plurality of nozzles 11, a plurality of individual-supply channels 22 respectively communicating with the plurality of pressure chambers 21, and a plurality of individual-collection channels 23 respectively communicating with the plurality of pressure chambers 21 (see FIG. 19).

The diaphragm member 30 forms a vibration portion 31 serving as a deformable wall of the pressure chamber 21, and the piezoelectric element 42 is formed on the vibration portion 31 so that the piezoelectric element 42 and the vibration portion 31 form a single body. Further, the diaphragm member 30 includes a supply opening 32 that communicates with the individual-supply channel 22 and a collection opening 33 that communicates with the individual-collection channel 23 (see FIG. 19). The piezoelectric element 42 is a pressure generating element to deform the vibration portion 31 to apply a pressure to the liquid in the pressure chamber 21.

Note that the individual-channel member 20 and the diaphragm member 30 are not limited to be separate members. The diaphragm member 30 includes a member made of materials that are film-formed on a surface of the individual-channel member 20.

The common channel member 50 includes a plurality of common-supply branch channels 52 that communicate with two or more individual-supply channels 22 and a plurality of common-collection branch channels 53 that communicate with two or more individual-collection channels 23. The plurality of common-supply branch channels 52 and the plurality of common-collection branch channels 53 are arranged alternately adjacent to each other. The common channel member 50 is a common branch channel member.

As illustrated in FIG. 19, the common channel member 50 includes a through hole serving as a supply port 54 that connects the supply opening 32 of the individual-supply channel 22 and the common-supply branch channel 52, and a through hole serving as a collection port 55 that connects the collection opening 33 of the individual-collection channel 23 and the common-collection branch channel 53.

The common channel member 50 includes one or more common-supply main channels 56 (see FIG. 17) that communicate with the plurality of common-supply branch channels 52 (see FIG. 18), and one or more common-collection main channels 57 (see FIG. 17) that communicate with the plurality of common-collection branch channels 53 (see FIG. 18). A part 56*a* is a part of the common-supply main channels 56, and a part 57*a* is a part of the common-collection main channels 57 (see FIG. 16).

The damper 60 mainly acts to attenuate a pressure wave from the pressure chamber 21 to the common-supply branch channel 52 and the common-collection branch channel 53.

As illustrated in FIGS. 17 and 18, the damper 60 seals grooves alternately arrayed in the same common channel member 50 to form the common-supply branch channels 52 and the common-collection branch channels 53. Thus, the damper 60 forms a deformable wall of the common-supply branch channels 52 and the common-collection branch channels 53.

The common channel member 70 forms a common-supply main channel 56 that communicates with the plurality of common-supply branch channels 52 and a common-collection main channel 57 that communicate with the plurality of common-collection branch channels 53 (see FIG. 17). The common channel member 70 is a common main channel member.

The frame 80 includes the part 56*a* of the common-supply main channel 56 and the part 57*a* of the common-collection main channel 57 (see FIG. 16). The part 56*a* of the common-supply main channel 56 communicates with the supply port 81 (see FIG. 15) in the frame 80. The part 57*a* of the common-collection main channel 57 communicates with the collection port 82 (see FIG. 15) in the frame 80.

In the head 1, the liquid supplied from an external liquid circulation path to the supply port 54 is supplied to the pressure chamber 21 through the common-supply main channel 56, the common-supply branch channel 52, and the individual-supply channel 22, and is discharged from the nozzle 11. The liquid not discharged from the nozzle 11 passes through the individual-collection channel 23, the collection port 55, the common-collection branch channel 53, the common-collection main channel 57, and is discharged outside the head 1 from the collection port 82.

The head 1 may form a submodule 101. Further, the submodule 101 and the manifold 102 may form the head module 100.

Figure 20:
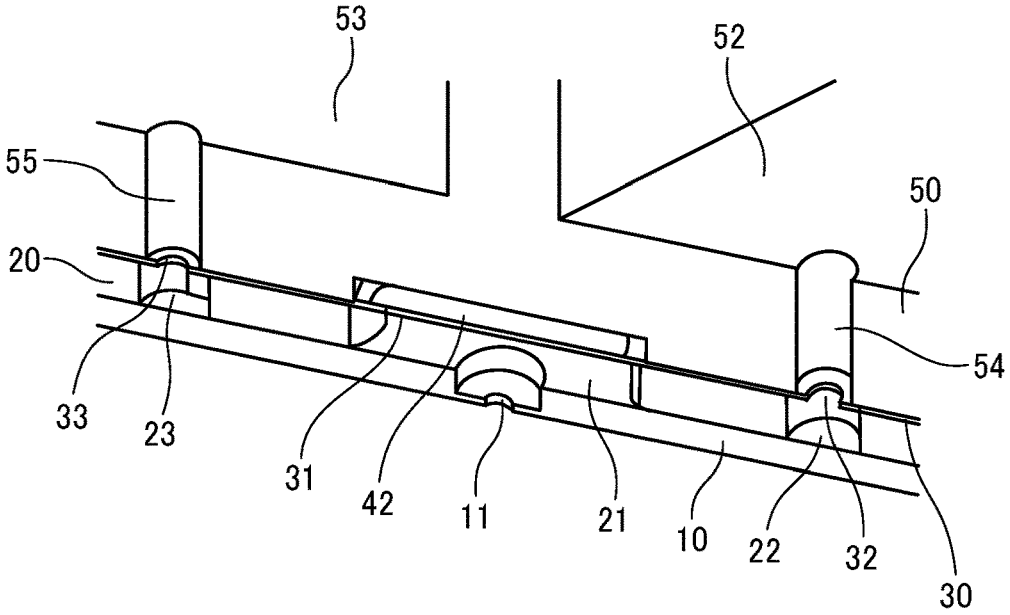
FIG. 20 is a schematic exploded cross-sectional perspective view of an example of a head module.
Figure 21:
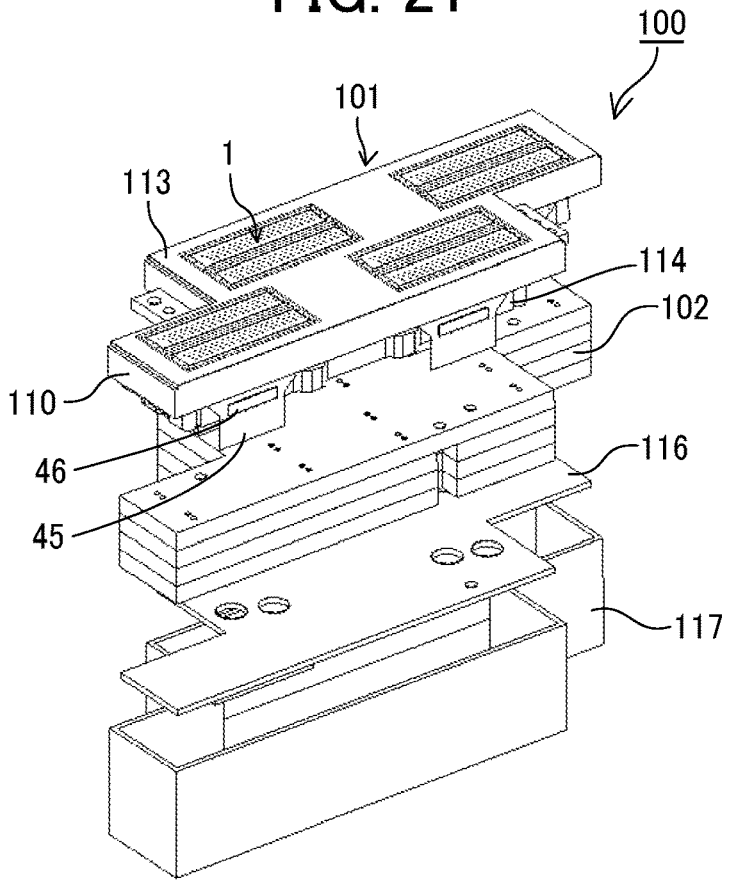
FIG. 21 is an exploded perspective view of the head module viewed from a nozzle surface side of the head module.

FIGS. 20 and 21 illustrate an example of the head module 100 according to an embodiment of the present disclosure.

FIG. 20 is an exploded cross-sectional perspective view of the head module 100.

FIG. 21 is an exploded perspective view of the head module 100 as viewed from the nozzle surface side of the head module 100.

The head module 100 includes a plurality of (here, eight) heads 1 configured to discharge a liquid on a base 110. The head module 100 further includes the submodule 101 to which a cover 113 serving as a nozzle cover for a plurality of heads 1 is attached.

Further, the head module 100 includes the manifold 102, a heat radiator 114, a printed circuit board 116 (PCB) connected to a flexible wiring board 45, and a module case 117.

The manifold 102 may include the supply channel 103, the collection channel 104, the supply damper 105, the collection damper 106, supply damper chamber 150, the collection damper chamber 160, and the channels 151 and 161 as described above.

Next, an example of a printer as a liquid discharge apparatus 500 according to an embodiment of the present disclosure is described with reference to FIGS. 22 and 23.

Figure 22:
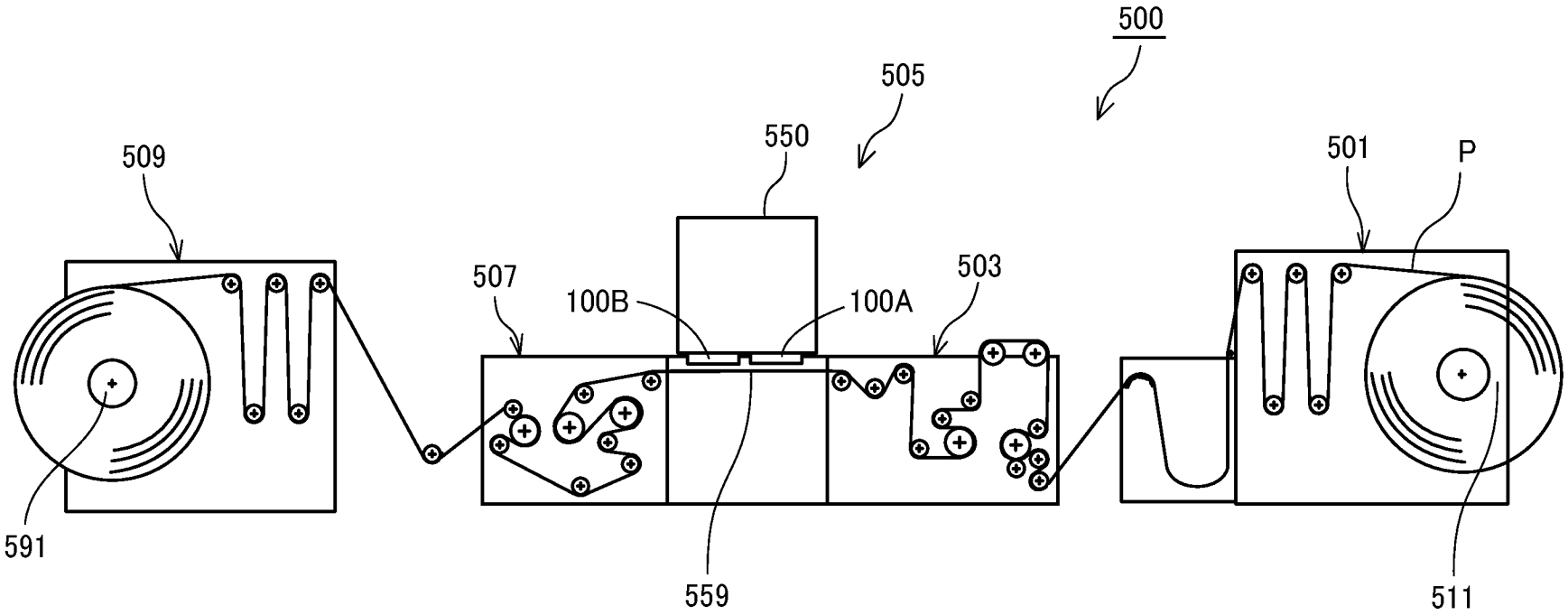
FIG. 22 is a schematic front view of a printer as a liquid discharge apparatus according to an embodiment of the present disclosure.

FIG. 22 is a side view of a liquid discharge apparatus 500 according to an embodiment of the present disclosure.

Figure 23:
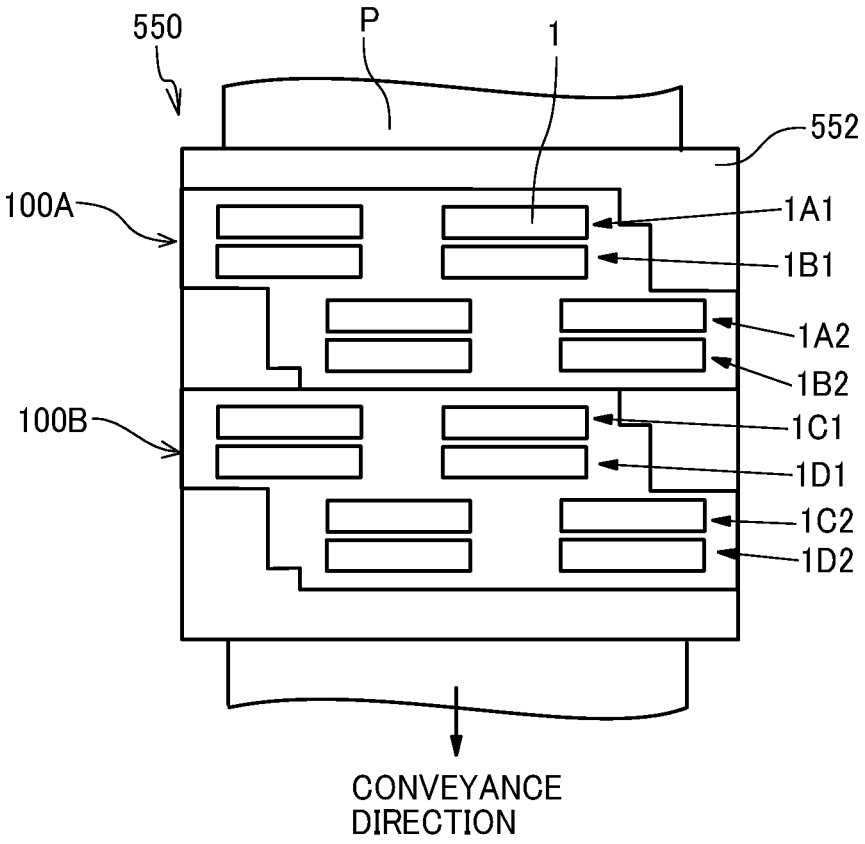
FIG. 23 is a plan view of a head unit of the liquid discharge apparatus of FIG. 22.

FIG. 23 is a plan view of a head unit 550 of the liquid discharge apparatus 500 of FIG. 22 according to the present embodiment.

The liquid discharge apparatus 500 is a printer that includes a loading device 501, a guide conveyor 503, a printing device 505, a drying device 507, and an ejection device 509.

The loading device 501 loads a web-like sheet P. The guide conveyor 503 guides and conveys the sheet P loaded by the loading device 501 to the printing device 505. The printing device 505 discharge a liquid onto the sheet P to form an image on the sheet P as a printing process. The drying device 507 dries the sheet P on which an image is formed by the printing device 505. The ejection device 509 ejects the sheet P conveyed from the drying device 507.

The sheet P is fed from a winding roller 511 of the loading device 501, guided and conveyed with rollers of the loading device 501, the guide conveyor 503, the drying device 507, and the ejection device 509, and wound around a take-up roller 591 of the ejection device 509.

In the printing device 505, the sheet P is conveyed opposite the head unit 550 on a conveyance guide 559. The head unit 550 discharges a liquid from the nozzles 11 of the heads 1 to form an image on the sheet P.

Here, the head unit 550 includes two head modules 100A and 100B according to the present embodiment on a common base member 552 (see FIG. 23).

The head module 100A includes head arrays 1A1, 1B1, 1A2, and 1B2. Each of the head arrays 1A1, 1B1, 1A2, and 1B2 includes a plurality of heads 1 arranged in a head array direction perpendicular to a conveyance direction of the sheet P as indicated by arrow in FIG. 23. The head module 100B includes head arrays 1C1, 1D1, 1C2, and 1D2. Each of the head arrays 1C1, 1D1, 1C2, and 1D2 includes a plurality of heads 1 arranged in the head array direction perpendicular to the conveyance direction of the sheet P. The head 1 in each of the head arrays 1A1 and 1A2 of the head module 100A discharges liquid of the same desired color. Similarly, the head arrays 1B1 and 1B2 of the head module 100A are grouped as one set that discharge liquid of the same desired color. The head arrays 1C1 and 1C2 of the head module 100B are grouped as one set that discharge liquid of the same desired color. The head arrays 1D1 and 1D2 of the head module 100B are grouped as one set to discharge liquid of the same desired color.

Figure 24:
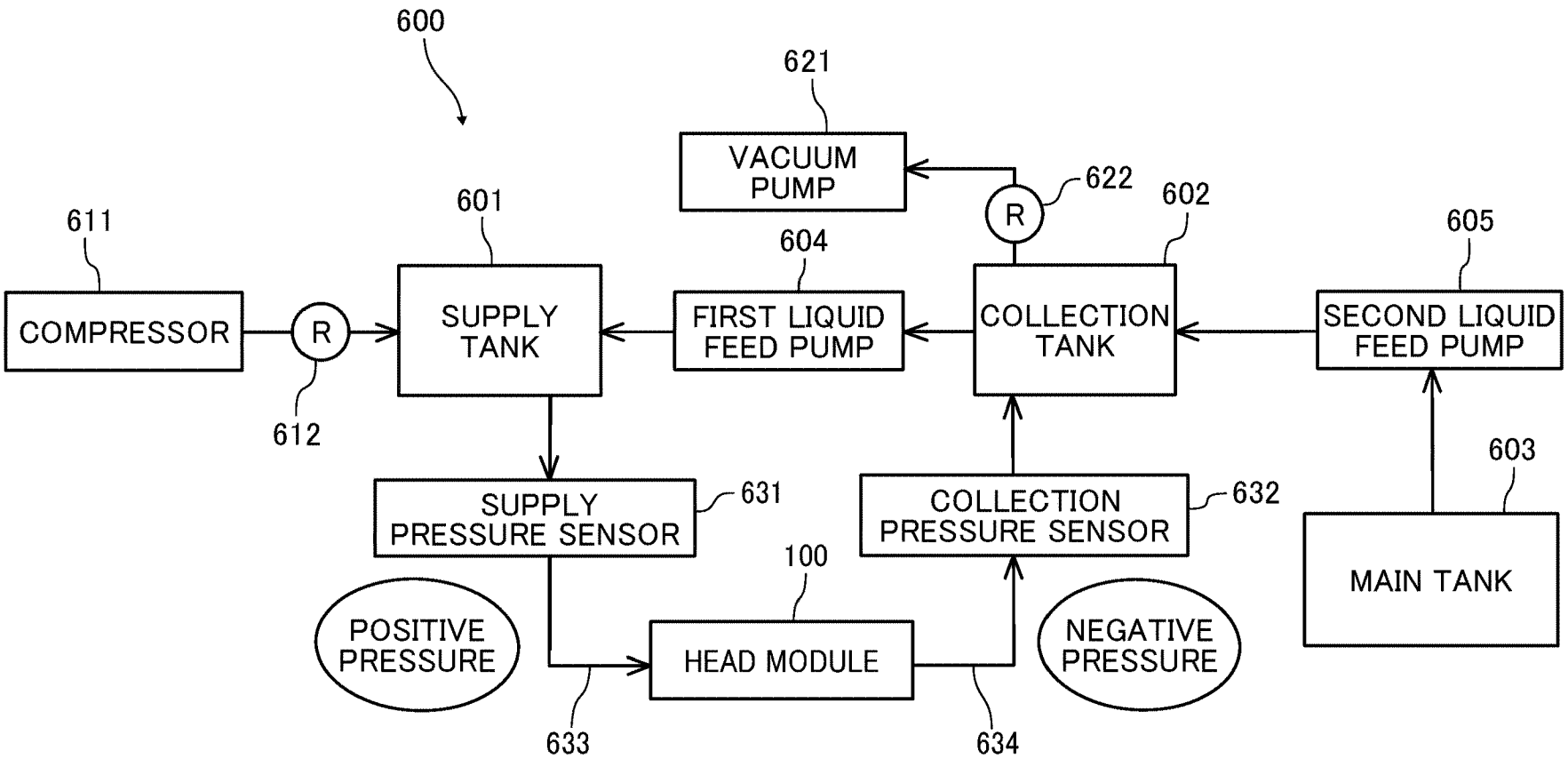
FIG. 24 is a circuit diagram illustrating an example of a liquid circulation device according to an embodiment of the present disclosure.

Next, following describes an example of a liquid circulation device 600 employed in a liquid discharge apparatus 500 according to the present embodiment with reference to FIG. 24.

FIG. 24 is a circuit diagram illustrating a structure of the liquid circulation device 600.

The liquid circulation device 600 includes a supply tank 601, a collection tank 602, a main tank 603, a first liquid feed pump 604, a second liquid feed pump 605, a compressor 611, a regulator 612, a vacuum pump 621, and a regulator 622.

The compressor 611 and the vacuum pump 621 together generate a difference between the pressure in the supply tank 601 and the pressure in the collection tank 602.

The liquid circulation device 600 includes a supply pressure sensor 631 on the liquid supply channel 633 between the supply tank 601 and the head module 100. The liquid circulation device 600 includes a collection pressure sensor 632 on the liquid collection channel 634 between the collection tank 602 and the head module 100.

One end of the collection tank 602 is coupled to the supply tank 601 via the first liquid feed pump 604, and another end of the collection tank 602 is coupled to the main tank 603 via the second liquid feed pump 605.

Accordingly, the liquid flows from the supply tank 601 into the head 1 in the head module 100 via the supply port 81 of the head 1. The liquid is collected from the collection port 82 of the head 1 to the collection tank 602. Further, the first liquid feed pump 604 feeds the liquid from the collection tank 602 to the supply tank 601. Thus, the liquid circulation device 600 forms a circulation path in which the liquid circulates through the head 1.

Here, a compressor 611 is connected to the supply tank 601 and is controlled so that a predetermined positive pressure is detected by the supply pressure sensor 631. Conversely, a vacuum pump 621 is connected to the collection tank 602 and is controlled so that a predetermined negative pressure is detected by the collection pressure sensor 632.

Such a configuration allows the menisci of ink in the nozzle 11 of the head 1 to be maintained at a constant negative pressure while circulating the liquid through an interior of the head 1 of the head module 100.

When liquids are discharged from the nozzles 11 of the head 1, an amount of liquid in each of the supply tank 601 and the collection tank 602 decreases. Accordingly, the collection tank 602 is replenished with the liquid fed from the main tank 603 by the second liquid feed pump 605.

The timing of supply of liquid from the main tank 603 to the collection tank 602 can be controlled in accordance with a result of detection by a liquid level sensor in the collection tank 602. For example, the liquid is supplied to the collection tank 602 from the main tank 603 when the liquid level in the collection tank 602 becomes lower than a predetermined height.

In the present embodiments, a "liquid" discharged from the head is not particularly limited as long as the liquid has a viscosity and surface tension of degrees dischargeable from the head.

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or unit(s) combined to the head to form a single unit.

For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms a part of a maintenance unit may be secured to the carriage mounting the head so that the head, the carriage, and the maintenance unit form a single unit to form the liquid discharge device.

Further, in another example, the liquid discharge device includes tubes connected to the head mounting the head tank or the channel member so that the head and a supply unit form a single unit. Liquid is supplied from a liquid reservoir source to the head via the tube.

The main scan moving unit may be a guide only. The supply unit may be a tube(s) only or a loading unit only.

The "liquid discharge device" includes a head module including the above-described head, and a head device in which the above-described functional components and mechanisms are combined to form a single unit.

The term "liquid discharge apparatus" used herein also represents an apparatus including the head, the liquid discharge device, the head module, and the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to discharge ink onto a sheet to form an image on the sheet, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet surface to coat the treatment liquid on the sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a plurality of heads to discharge a liquid;

a supply channel connected to the plurality of heads to supply the liquid to the plurality of heads;

a collection channel connected to the plurality of heads to collect the liquid from the plurality of heads;

a supply damper to define a deformable wall of the supply channel;

a collection damper to define a deformable wall of the collection channel;

a supply damper chamber facing the supply damper;

a collection damper chamber facing the collection damper;

a pressure pump to apply a pressure to the supply damper chamber so as to apply a positive pressure on the supply damper in a direction opposite to a direction of a positive circulation pressure on the supply damper applied by the liquid in the supply channel; and a depressurize pump to apply a negative pressure to the collection damper chamber so as to apply a negative pressure on the collection damper in a direction opposite to a direction of a negative circulation pressure on the collection damper applied by the liquid in the collection channel.

2. The liquid discharge apparatus according to claim 1, wherein the supply channel includes:

a plurality of individual-supply channels respectively communicating with the plurality of heads; and a common-supply channel connected to each of the plurality of individual-supply channels, the collection channel includes:

a plurality of individual-collection channels respectively communicating with the plurality of heads; and a common-collection channel connected to each of the plurality of individual-collection channels, and the supply damper includes a plurality of supply dampers respectively defines a plurality of deformable walls of the plurality of individual-supply channels, the collection damper includes a plurality of collection dampers respectively defines a plurality of deformable walls of the plurality of individual-collection channels, the supply damper chamber includes a plurality of supply damper chambers respectively facing the plurality of supply dampers, and the collection damper chamber includes a plurality of collection damper chambers respectively facing the plurality of collection dampers.

3. The liquid discharge apparatus according to claim 1, wherein the supply channel includes:

a plurality of individual-supply channels respectively communicating with the plurality of heads; and a common-supply channel connected to each of the plurality of individual-supply channels, the collection channel includes:

a plurality of individual-collection channels respectively communicating with the plurality of heads; and a common-collection channel connected to each of the plurality of individual-collection channels, the supply damper to define a deformable wall of the common-supply channel, and the collection damper to define a deformable wall of the common-collection channel.

4. The liquid discharge apparatus according to claim 1, further comprising:

a submodule including the plurality of heads in a single body; and a manifold connected to the submodule, the manifold including the supply channel, the collection channel, the supply damper, the supply damper chamber, the collection damper, and the collection damper chamber in a single body.

5. The liquid discharge apparatus according to claim 1, wherein the supply channel includes a supply tank to store the liquid to be supplied to the plurality of heads, the collection channel includes a tank configured to store the liquid collected from the plurality of heads, the supply damper to define a deformable wall of the supply tank, and the collection damper to define a deformable wall of the collection tank.

6. The liquid discharge apparatus according to claim 1, wherein the supply channel includes:

a supply tank to store the liquid to be supplied to the plurality of heads; and a liquid supply channel connecting the supply tank and the plurality of heads, the collection channel includes:

a collection tank to store the liquid collected from the plurality of heads; and a liquid collection channel connecting the collection tank and the plurality of heads, wherein the supply damper defines a deformable wall of the liquid supply channel, and the collection damper defines a deformable wall of the liquid collection channel.

7. A liquid discharge apparatus comprising:

a head to discharge a liquid;

a pressure pump to apply a pressure to the head; and a depressurize pump to apply a negative pressure to the head, wherein the head comprises:

a plurality of nozzles from which a liquid is discharged;

a plurality of pressure chambers respectively communicating with the plurality of nozzles;

a common-supply channel connected to each of the plurality of pressure chambers, wherein the common-supply channel supplies the liquid to each of the plurality of pressure chambers;

a common-collection channel connected to each of the plurality of pressure chambers, wherein the common-collection channel collects the liquid from each of the plurality of pressure chambers;

a supply damper to define a deformable wall of the common-supply channel;

a collection damper to define a deformable wall of the common-collection channel;

a supply damper chamber facing the supply damper; and a collection damper chamber facing the collection damper, wherein the pressure pump applies the pressure to the supply damper chamber in the head so as to apply a positive pressure on the supply damper in a direction opposite to a direction of a positive circulation pressure on the supply damper applied by the liquid in the common-supply channel; and the depressurize pump applies the negative pressure to the collection damper chamber in the head so as to apply a negative pressure on the collection damper in a direction opposite to a direction of a negative circulation pressure on the collection damper applied by the liquid in the common-collection channel.

* * * * *